US010132034B2

(12) United States Patent
Bjerke et al.

(10) Patent No.: US 10,132,034 B2
(45) Date of Patent: Nov. 20, 2018

(54) SUCTION DEVICE FOR USE IN A PAPERMAKING MACHINE AND A PAPERMAKING MACHINE USING A SUCTION DEVICE

(71) Applicant: Valmet Aktiebolag, Sundsvall (SE)

(72) Inventors: Michael Bjerke, Hammaroe (SE); Dennis Jewitt, Kent (GB); Mattias Johansson, Kil (SE)

(73) Assignee: Valmet Aktiebolag, Sundsvall (SE)

( * ) Notice: Subject to any disclaimer, the term of this patent is extended or adjusted under 35 U.S.C. 154(b) by 0 days.

(21) Appl. No.: 15/763,401

(22) PCT Filed: Nov. 12, 2015

(86) PCT No.: PCT/SE2015/051208

§ 371 (c)(1),
(2) Date: Mar. 26, 2018

(87) PCT Pub. No.: WO2017/082788

PCT Pub. Date: May 18, 2017

(65) Prior Publication Data

US 2018/0298555 A1 Oct. 18, 2018

(51) Int. Cl.

| | |
|---|---|
| ***D21F 1/52*** | (2006.01) |
| ***D21F 5/18*** | (2006.01) |
| ***D21F 11/14*** | (2006.01) |

(52) U.S. Cl.

CPC ..... *D21F 1/52* (2013.01); *D21F 5/18* (2013.01); *D21F 11/145* (2013.01)

(58) Field of Classification Search

CPC ..... D21F 4/52; D21F 5/18; D21F 1/48; D21F 11/145; D21F 9/00

See application file for complete search history.

(56) References Cited

U.S. PATENT DOCUMENTS 3,928,125 A * 12/1975 Poeschl ..... D21F 1/483 162/352
4,781,795 A * 11/1988 Miller ..... B30B 5/04 100/153

(Continued)

FOREIGN PATENT DOCUMENTS

| | | | | |
|---|---|---|---|---|
| CA | 2997412 A1 * | 5/2017 | ..... | D21F 1/52 |
| GB | 2418929 A | 4/2006 | | |
| WO | WO-2017082788 A1 * | 5/2017 | ..... | D21F 1/52 |

OTHER PUBLICATIONS

International Searching Authority, International Search Report and Written Opinion for International Application No. PCT/SE2015/051208, dated Jul. 20, 2016, 10 pages, Swedish Patent and Registration Office, Sweden.

*Primary Examiner* — Jose A Fortuna
(74) *Attorney, Agent, or Firm* — Alston & Bird LLP

(57) ABSTRACT

The invention relates to a suction device (15) for use in a papermaking machine and being suitable for acting on a wet fibrous web through a permeable fabric (4, 6), e.g. a through-air-drying (TAD)-fabric. The suction device has a fabric-facing surface (18) formed by a plurality of end surfaces of solid elements (21, 22). Channels (24, 25) are defined between the solid elements. The end surface of the final solid element (22) does not lie in the same plane as the end surfaces of the previous solid elements (21). Thereby, a gap A is formed between the fabric (4, 6) and the final solid element (22). This allows air to flow through the gap and into a final channel (25). The air flow will then catch fines, small fibers and water droplets and draw them into the final channel (25) thereby counteracting a build-up of large lumps of fines and fibers.

12 Claims, 9 Drawing Sheets

(56) References Cited

U.S. PATENT DOCUMENTS

| | | | | |
|---|---|---|---|---|
| 5,718,806 | A | 2/1998 | Trokhan et al. | |
| 6,306,257 | B1 * | 10/2001 | Hada | D21F 1/48 162/290 |
| 2008/0035290 | A1 | 2/2008 | Andersson et al. | |

* cited by examiner

SUCTION DEVICE FOR USE IN A PAPERMAKING MACHINE AND A PAPERMAKING MACHINE USING A SUCTION DEVICE

CROSS REFERENCE TO RELATED APPLICATIONS

This application is a National Stage Application, filed under 35 U.S.C. § 371, of International Application No. PCT/SE2015/051208, filed Nov. 12, 2015; the contents of which as are hereby incorporated by reference in their entirety.

BACKGROUND

Related Field

The present invention relates to a suction device for use in a papermaking machine. The suction device may be, for example, a moulding box intended for a through-air drying machine. The invention also relates to a papermaking machine that uses the inventive suction device.

Description of Related Art

In papermaking machines, various kinds of suction devices are used that act on fibrous webs through a fabric that is permeable to air and water. One use for such suction devices is as moulding boxes in through-air drying machines, i.e. TAD machines. In a TAD machine, a wet fibrous web is dried as it is carried over one or several TAD cylinders on a permeable fabric with an imprinting pattern. To imprint a three-dimensional patterns into the fibrous web that is manufactured, the web and the permeable fabric can made to pass a moulding box before the web is carried by the permeable fabric to the TAD cylinder or cylinders. The moulding box is a suction device that draws the fibrous web towards the permeable fabric as the web and the permeable fabric passes the moulding box. This causes the wet fibrous web to be drawn into the permeable fabric such that the pattern of the permeable fabric is imprinted into the wet fibrous web. The pattern which has been imprinted into the wet fibrous web will remain when the fibrous web has been dried. An example of a moulding box is disclosed in, for example, U.S. Pat. No. 5,718,806. The inventors of the present invention have noted that, in paper making machines using suction devices such as moulding boxes, there may be disturbances in the area downstream of the suction device and that this may sometimes be caused by the suction device itself. Therefore, it is an object of the present invention to provide an improved suction device that can be used, for example, as a moulding box in TAD machines.

BRIEF SUMMARY

The invention relates to a suction device for use in a papermaking machine. The inventive suction device is suitable for acting on a wet fibrous web through a permeable fabric that runs through a part of the papermaking machine. The suction device according to the invention has a length that extends from a first end to a second end which first end is an upstream end when the suction device is used in the papermaking machine and which second end is a downstream end when the suction device is used in the papermaking machine and the direction from the first end to the second end is the machine direction when the suction device is used in the papermaking machine. The suction device further has a width which is perpendicular to the length of the suction device and extends in the cross-machine direction when the suction device is used in the papermaking machine. The inventive suction device further has a surface which, during use of the suction device in the papermaking machine, will be facing the permeable fabric and thus be a fabric-facing surface. The fabric-facing surface has a first part which begins at the first end of the suction device and extends towards the second end but ends before the second end of the suction device. The first part of the fabric-facing surface is formed by a plurality of planar surfaces which planar surfaces constitute end surfaces of a plurality of solid elements. The planar surfaces of the solid elements in the first part of the fabric-facing surface lie in the same plane such that, during operation, they can contact a fabric gliding over the fabric-facing surface along a straight path. The solid elements are separated from each other along the length of the suction device such that channels are defined between the solid elements and the suction device is configured to be connected to at least one source of underpressure in such a way that the at least one source of underpressure is in communication with the channels defined between the solid elements such that, when the suction device is used and the permeable fabric runs over the fabric-facing surface, the suction device can act on the permeable fabric through the channels and draw the permeable fabric by suction effect towards the fabric-facing surface. The first part of the fabric-facing surface is followed by a second part of the fabric-facing surface which second part of the fabric-facing surface is a surface formed as an end surface of a final solid element and which end surface of the final solid element does not lie in the same plane as planar surfaces of the solid elements belonging to the first part of the fabric-facing surface. Instead, it is spaced from the plane in which the planar surfaces of the solid elements belonging to the first part of the fabric-facing surface lie such that, when the permeable fabric passes over the suction device and moves past the final solid element along the plane of the planar surfaces of the solid elements belonging to the first part of the fabric-facing surface, the permeable fabric will not contact the final solid element. The final solid element is separated from a preceding solid element such that a final channel is defined between the final solid element and the preceding solid element. The final channel is capable of communicating with at least one source of underpressure for the final channel when the at least one source of underpressure for the final channel is connected to the suction device such that an underpressure can be generated in the area between the permeable fabric and the surface of the final solid element.

The solid elements are ribs that extend in a direction perpendicular to the machine direction and the cross machine direction, i.e. perpendicular to the length and width dimension of the suction device. The ribs having ends at the fabric-facing surface which ends constitute the surfaces of the solid elements.

In embodiments of the invention, at least the ends of the ribs that constitute surfaces of the solid elements in the first part of the fabric-facing surface are made of a ceramic material.

In embodiments of the invention, at least a part of the final channel formed between the ribs that constitute the final solid element and the solid element immediately preceding the final solid element has a smaller cross-sectional area than the preceding channels. In such embodiments, the final channel formed between the ribs that constitute the final solid element and the solid element immediately preceding the final solid element may be provided with a flow restrictor.

In embodiments of the invention, the suction device is configured such that the channels defined between the solid elements of the first part of the fabric-facing surface can be connected to and communicate with at least one first source of underpressure and that the final channel can be connected to and communicate with at least one second source of underpressure which is separate from the at least one first source or underpressure.

In some embodiments, the suction device may be formed as a single unit.

In other embodiments, the suction device may be formed by a first unit and a second unit which first and second units are physically separate from each other. In such embodiments, the first part of the fabric-facing surface can be formed on the first unit and the second fabric-facing surface formed on the second unit.

In embodiments of the invention, the suction device may be configured such that both the channels defined between the solid elements of the first part of the fabric-facing surface and the final channel all can be connected to and communicate with at least one common source of underpressure.

The invention may also be defined in terms of a papermaking machine that makes use of the inventive suction device. Such a papermaking machine may comprise a forming section and a drying section and the machine being will be arranged to cause a newly formed fibrous web to move along a path of travel that extends in the machine direction from the forming section to and into the drying section. The inventive papermaking machine comprises an endless permeable fabric and a plurality of guide rolls around which the endless permeable fabric runs in a loop. The endless permeable fabric is arranged to carry the fibrous web at least a part of the path of travel of the web and the inventive suction device is arranged inside the loop of the endless permeable fabric with the fabric-facing surface facing the endless permeable fabric.

The papermaking machine may be a machine that has a drying section that comprises a through-air-drying cylinder. The endless permeable fabric may then be a through-air-drying fabric which is arranged to wrap a part of the through-air-drying cylinder and the inventive suction device is then placed within the loop of the permeable fabric such that it can act on the permeable fabric and on a fibrous web that is carried by the permeable fabric and separated from the suction device by the permeable fabric. The inventive suction device is then placed upstream of the through-air-drying cylinder such that it acts on the permeable fabric before the permeable fabric reaches the through-air-drying cylinder and the fabric-facing surface of the suction device then has an orientation that is more vertical than horizontal.

In other embodiments, the endless permeable fabric may be a forming fabric in the forming section and the fabric-facing surface of the suction device may have an orientation that is horizontal or deviates from a horizontal orientation by no more than 15°. In such embodiments, the fabric-facing surface of the suction device is facing downwards such that the permeable fabric passes below the suction device.

DETAILED DESCRIPTION OF VARIOUS EMBODIMENTS

Figure 1:
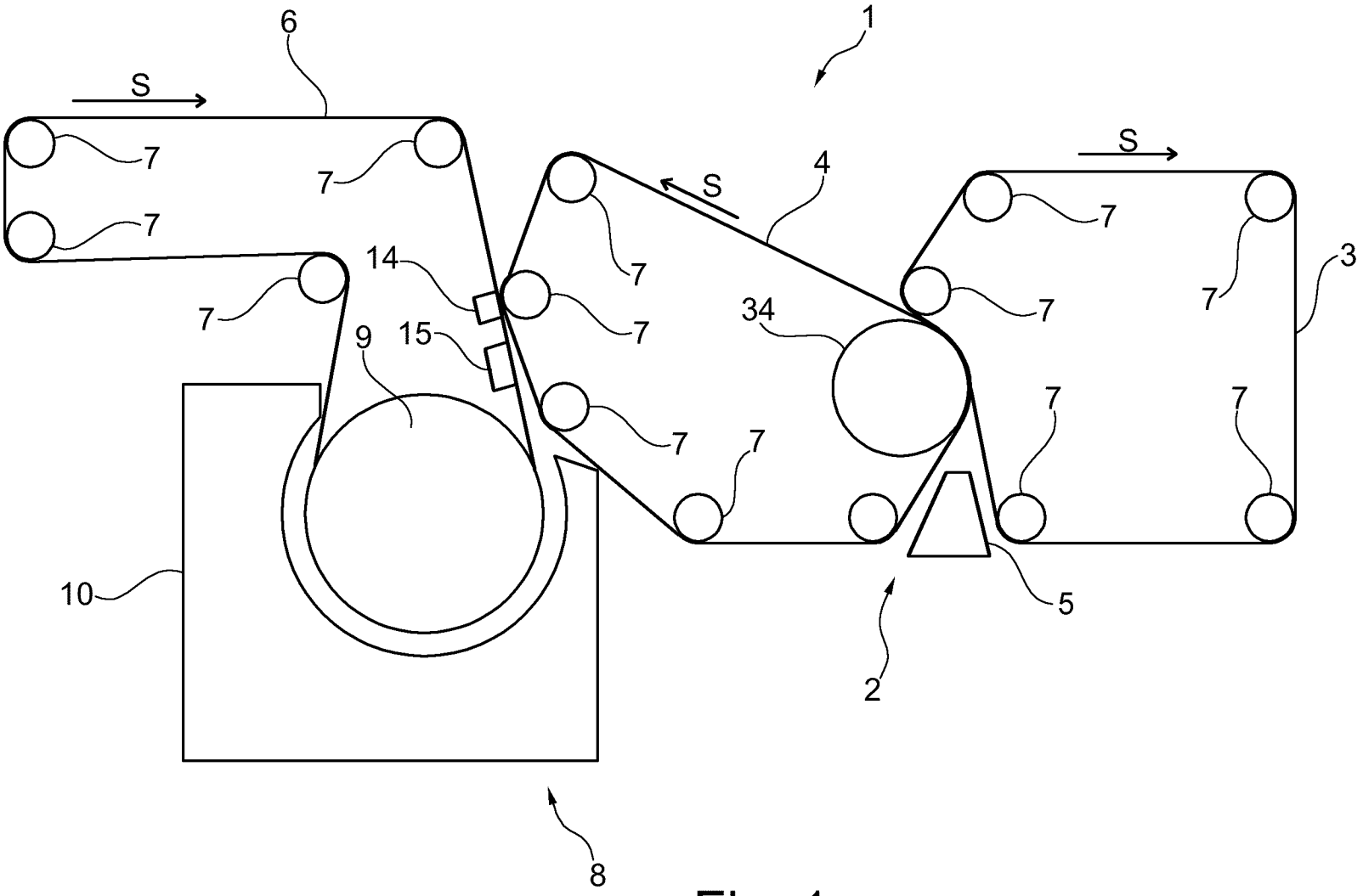
FIG. 1 is a side view that shows an example of a paper making machine in which the inventive suction device may be used.

With reference to FIG. 1, a papermaking machine 1 is shown. The papermaking machine 1 of FIG. 1 is a machine intended for manufacturing a tissue paper web with high bulk such as, for example, TAD paper. The machine may be intended for manufacturing tissue paper that has a basis weight that may be in the range of, for example, 12 g/m$^2$-40 g/m$^2$ and may include such grades as, for example, toilet paper or kitchen towel. The papermaking machine of FIG. 1 comprises a forming section 2 with a first forming fabric 3 and a second forming fabric 4. The forming fabrics 3, 4 may be, for example, foraminous forming wires that are air and water permeable. Each of the forming fabrics 3, 4 is arranged to run in a loop supported by guide rolls 7. During operation, the forming fabrics 3, 4 will run in the direction indicated by the arrows S. A head box 5 is arranged to inject stock in a gap between the forming fabrics 3, 4 as is known in the art to which the invention pertains. The reference numeral 34 indicates a forming roll. The forming section is followed by a drying section 8 that comprises a through-air-drying cylinder 9 (TAD cylinder 9). From the second forming fabric 4, the newly formed fibrous web W is transferred to a subsequent permeable fabric 6. In the embodiment of FIG. 1, the permeable fabric 6 is a through-air drying fabric (TAD fabric) that is arranged to run in a loop supported by guide rolls 7 in the direction of arrow S. A pick-up suction device 14 may be arranged within the loop of the TAD fabric 6 to assist in transferring the fibrous web W from the forming fabric 4 to the TAD fabric 6. The web W is then carried on the TAD fabric 6 around a part of the circumference of the through-air drying cylinder 9 (TAD cylinder 9). The TAD cylinder 9 is arranged in a hood 10. The hood 10 and the TAD cylinder may be arranged to operate such that hot air passes from the hood 10, through the fibrous web W and the TAD fabric 6 and into the TAD cylinder 9 and the air may then be evacuated from the TAD cylinder 9 in an axial direction. Embodiments are conceivable in which the hot air goes the other way, i.e. from the inside of the TAD cylinder 9 and out through the TAD fabric 6 and the fibrous web W and into the hood 10. The fibrous web W is dried as it passes the TAD cylinder 9 and is then passed further, for example to a reel-up. The reel-up is not shown in the figures but, with reference to FIG. 1, it would normally be located to the left of the drying section 8. Such a reel-up could take many forms and it may be, for example, such a reel-up as is disclosed in U.S. Pat. No. 5,901,918. The arrangement of the reel-up in relation to the rest of the machine may be such that the reel-up is arranged to receive the fibrous web from the drying section 8, for example from the TAD fabric 6. The fibrous web may be sent from the drying section 8 in an open draw to the reel-up or supported by something, for example supported by a fabric. Embodiments are also conceivable in which the TAD cylinder 9 is followed by a Yankee drying cylinder (not shown) and in which the fibrous web is subsequently passed to a reel-up. Before the fibrous web W reaches the TAD cylinder 9, it passes a suction device 15 that is placed inside the loop of the permeable TAD fabric 6. At this stage, the fibrous web W may have a dryness of about 25% or perhaps even less and the web W can easily be shaped. The suction device 15 may be a moulding box intended to assist in creating a three-dimensional structure into the fibrous web W. As the fibrous web W passes the suction device 15, a suction effect from the suction device 15 pulls the fibrous web W against the TAD fabric 6. As the TAD fabric 6 has a three-dimensional pattern with knuckles, fibers in the fibrous web W will be partially sucked into the TAD fabric such that the TAD fabric creates a three-dimensional pattern in the surface of the fibrous web W, or at least into the side of the fibrous web that faces the TAD fabric. The suction device 15 plays an important role in this process.

Figure 2:
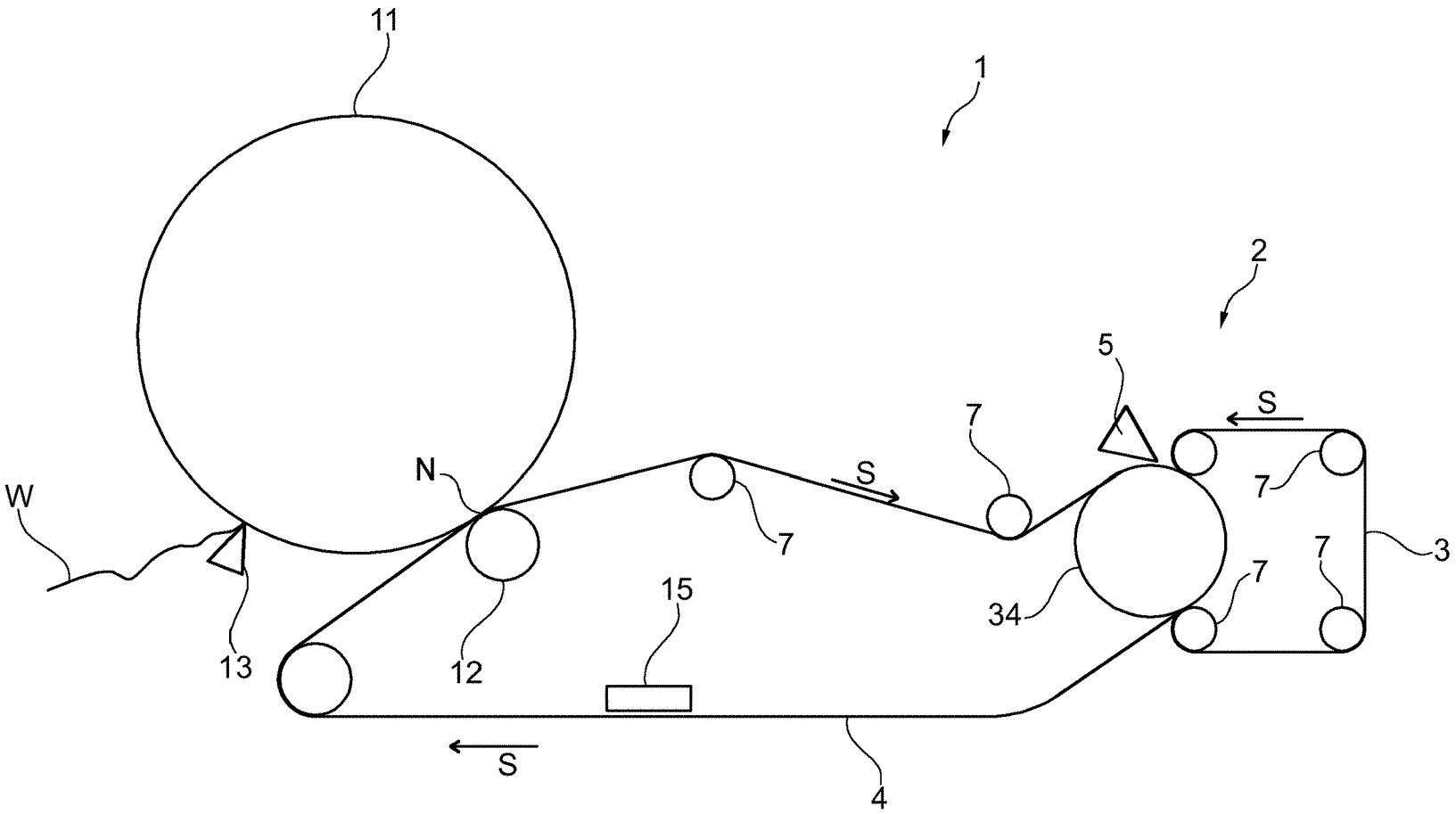
FIG. 2 is a side view of another paper making machine in which the inventive suction device may be used.

With reference to FIG. 2, a machine with a different layout is shown. The machine of FIG. 2 has a forming section 2 with a head box 5, a first forming fabric 3 and a second forming fabric 4. The fabrics 3, 4 (both of which are water and air permeable fabrics) run in the direction of arrows S and they are supported in their loops by guide rolls 7.

The drying section 8 comprises a drying cylinder 11 which may be a Yankee drying cylinder 11. In operation, a newly formed fibrous web W travels on the lower side of the permeable fabric 4 (the fabric 4 may be a felt) to a nip N between a press roll 12 and the Yankee drying cylinder 11. In the nip N, the web W is transferred to the surface of the Yankee drying cylinder 11. The surface of the Yankee drying cylinder 11 is smoother than the surface of the fabric 4 which would typically be a felt. Since the surface of the Yankee drying cylinder is smoother than the surface of the fabric 4, the web W will follow the surface of the Yankee drying cylinder 11 after the nip N. On the Yankee drying cylinder 11, the web W is dried and subsequently creped from the surface of the Yankee drying cylinder by a doctor 13.

In the machine shown in FIG. 2, a suction device 15 is placed inside the loop of the permeable fabric 4 and the suction device 15 may serve the purpose of dewatering. It should be understood that other machine configurations are also possible and the suction device 15 may be placed inside the loop of a wire, for example in order to achieve additional dewatering of the fibrous web.

A suction device acting on a fibrous web through a permeable fabric such as, for example, a TAD fabric, typically has a number of slots or openings through which underpressure can act. The underpressure (vacuum) sucks the fibrous web and the permeable fabric against the suction device. The inventors have noted that in some applications using a suction device inside the loop of a permeable fabric, there may be disturbances in the process downstream of the suction device. The inventors have now identified the operation of the suction device as one source of such disturbances. When a fibrous web carried on a permeable fabric passes a suction device, some fines and fibers will inevitably be sucked through the permeable fabric and the inventors have found that such fines and fibers tend to accumulate at a downstream end of the suction device and clog the suction device at its downstream end. At irregular intervals, pieces of wet fines and fibers may then fall of the suction device and follow into subsequent parts of the process and cause disturbances. The present invention aims at eliminating or at least reducing this problem such that disturbances of the papermaking process also can be reduced.

Figure 3:
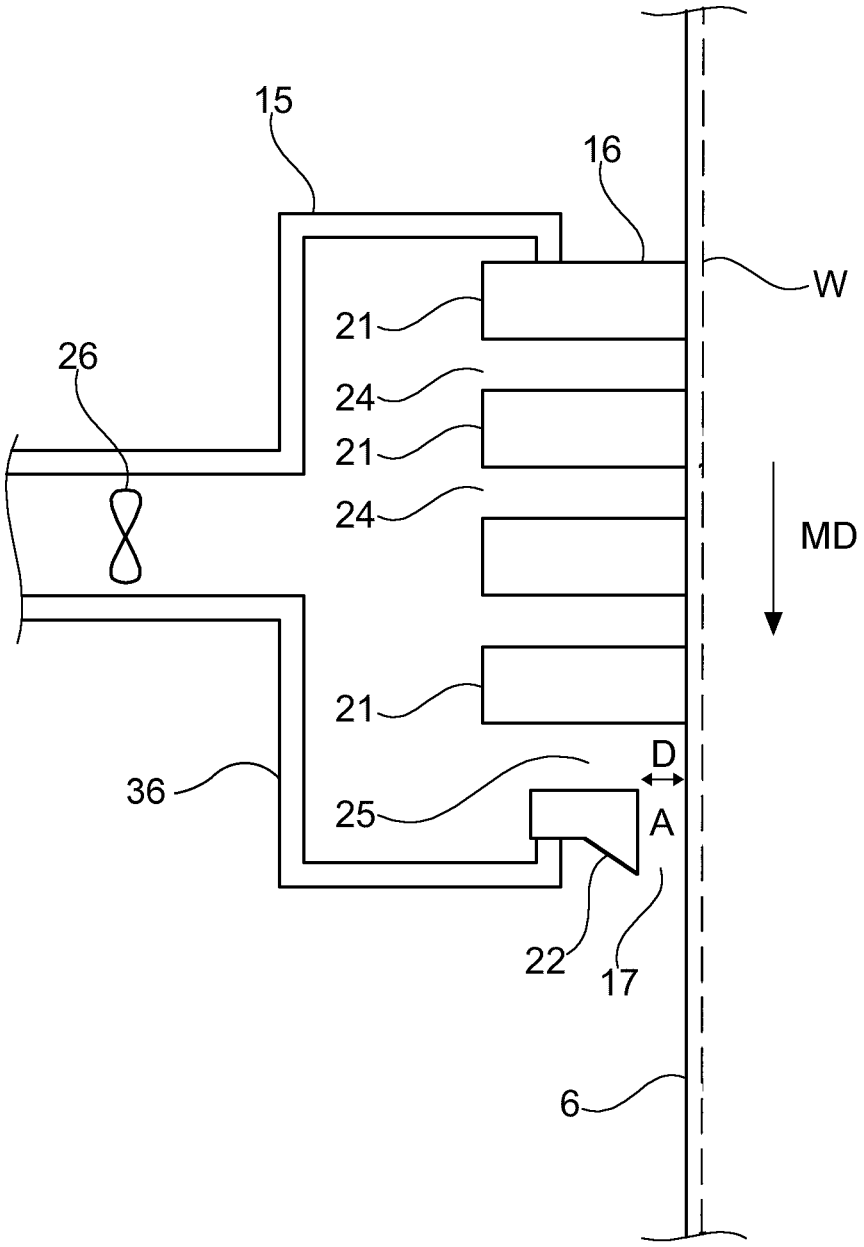
FIG. 3 shows, in cross section, a view of an embodiment of the inventive suction device in which the suction device acts against a permeable fabric on which a fibrous web is carried.
Figure 4:
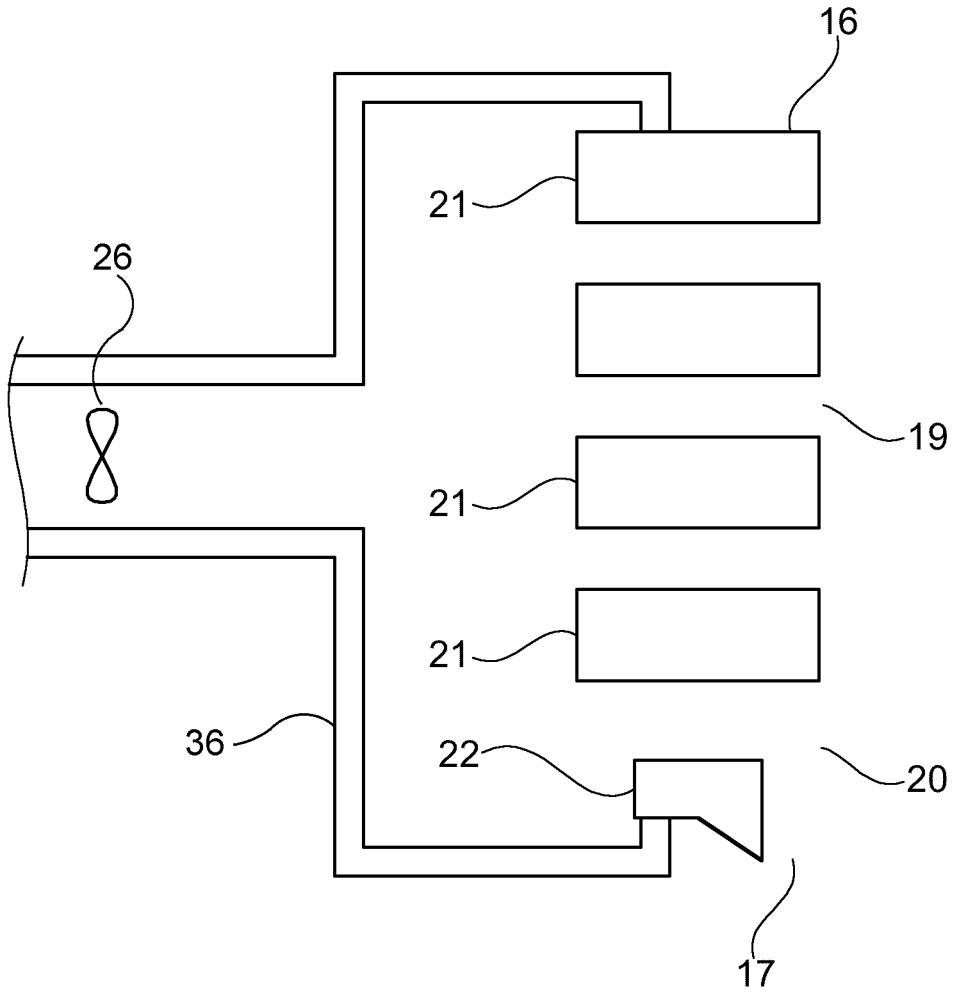
FIG. 4 is a view similar to that of FIG. 3 but in which the suction device is shown without the permeable fabric and the fibrous web.
Figure 5:
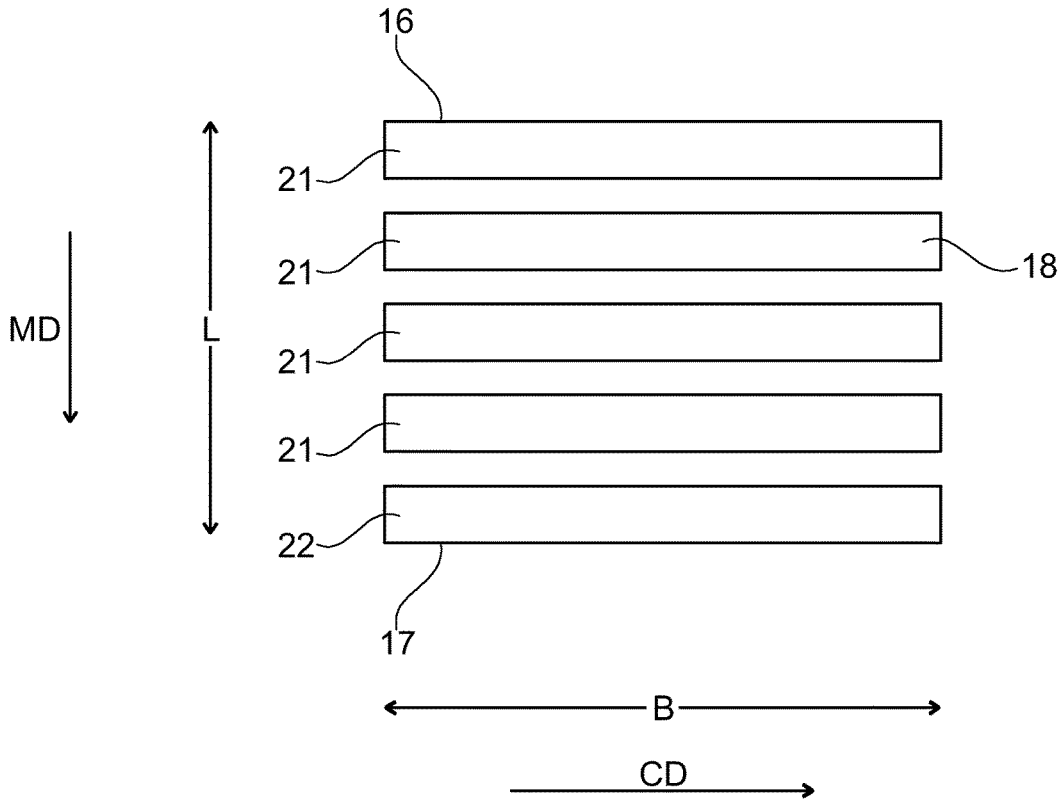
FIG. 5 shows a front view of the fabric-facing surface of the inventive suction device.
Figure 6:
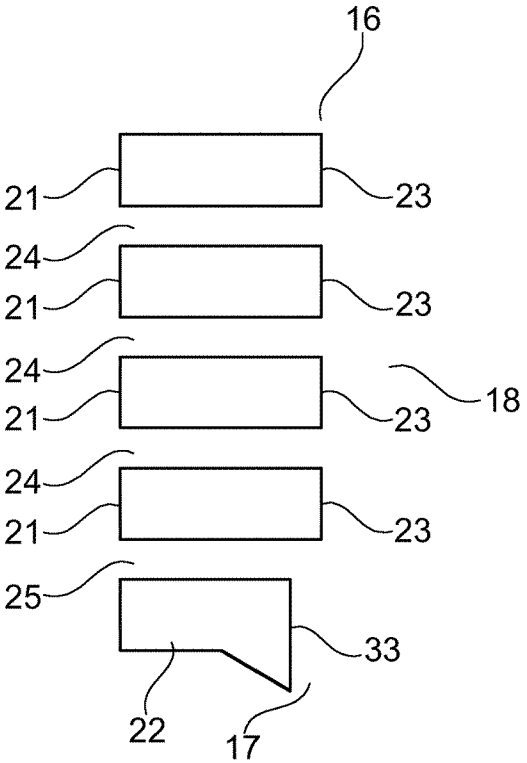
FIG. 6 is a view similar to FIG. 3 but in which, for clarity, only the solid elements are shown.

One embodiment of the present invention will now be explained with reference to FIG. 3-FIG. 7. FIG. 3 shows a suction device 15 for use in a papermaking machine 1. The suction device 15 is suitable for acting on a wet fibrous web W through a permeable fabric 6 that runs through a part of the papermaking machine 1. The permeable fabric 6 may be a TAD fabric which has a three-dimensional pattern that can be formed by, for example, longitudinal yarns extending in the machine direction and transverse yarns extending in the cross machine direction. The three-dimensional pattern may include knuckles and recessed portions surrounding the knuckles. As best seen in FIG. 5, the suction device 15 has a length L that extends from a first end 16 to a second end 17. The first end 16 is an upstream end when the suction device 15 is used in the papermaking machine 1 and the second end 17 is a downstream end when the suction device 15 is used in the papermaking machine 1. In FIG. 3, FIG. 4 and FIG. 5, the direction from the first end 16 to the second end 17 is the machine direction MD when the suction device 15 is used in the papermaking machine 1. As can be seen in FIG. 5, the suction device 15 further has a width B which is perpendicular to the length L of the suction device 15. The width B extends in the cross-machine direction (the CD direction) when the suction device 15 is used in the papermaking machine 1. With reference to FIG. 5 and FIG. 6, the suction device 15 has a surface 18 which, during use of the suction device 15 in the papermaking machine, will be facing the permeable fabric 4, 6 and thus be a fabric-facing surface 18. As can be seen in FIG. 4, the fabric-facing surface 18 has a first part 19 which begins at the first end 16 of the suction device 15 and extends towards the second end 17 but ends before the second end 17 of the suction device. The first part 19 of the fabric-facing surface 18 is formed by planar surfaces 23 (see FIG. 6) on a plurality of solid elements 21 which planar surfaces 23 form a part of the fabric-facing surface 18. The planar surfaces 23 of the solid elements 21 in the first part 19 of the fabric-facing surface 18 lie in the same plane such that, during operation, they can contact a fabric 4, 6 that glides over the fabric-facing surface 18 along a straight path. The solid elements 21 are separated from each other along the length of the suction device 15 such that channels 24 are defined between the solid elements 21. The spacing between the solid elements 21 may vary from case to case but in some embodiments contemplated by the inventors, the distance that separates the solid elements 21 from each other in the machine direction may be on the order of 15 mm-25 mm, for example 18 mm. The spacing between the solid elements 21 may be the same for all solid elements 21 but it may conceivably also vary. The suction device 15 is configured to be connected to at least one source of underpressure which is symbolically indicated as a fan 26 in FIG. 3 and FIG. 4. In this way, the at least one source of underpressure 26 may communicate with the channels 24 defined between the solid elements 21 such that, when the suction device 15 is used and the permeable fabric 6 runs over the fabric-facing surface 18, the suction device 15 can act on the permeable fabric 6 through the channels 24 and draw the permeable fabric 6 by suction effect towards the fabric-facing surface 18. According to the present invention, the first part 19 of the fabric-facing surface 18 is followed by a second part 20 of the fabric-facing surface 18. The second part 20 of the fabric-facing surface comprises a surface 33 (see FIG. 6) that does not lie in the same plane as the planar surfaces 23 of the solid elements belonging to the first part 19 of the fabric-facing surface 18 but is spaced from the plane in which the planar surfaces 23 of the solid elements 21 in the first part of the fabric-facing surface 18. It should be understood that the plane in which the surface 33 of the second part 20 of the fabric-facing surface 18 will normally be parallel or substantially parallel to the plane in which the planar surfaces 23 of the solid elements belonging to the first part of the fabric-facing surface 18 but the two planes are separated from each other in a direction which is normal to the two planes, i.e. perpendicular to the two planes. The surface 33 which does not lie in the same plane as the planar surfaces 23 in the first part of the fabric-facing surface 18 is formed on a final solid element 22 and can be seen as that end of the final solid element 22 which, during operation, will be facing the permeable fabric 6. In FIG. 3, it can be seen how the plane in which the planar surface 33 of the final solid element 22 lies is separated from the plane in which the planar surfaces 23 lie by a distance D. Therefore, when the permeable fabric 6 passes over the suction device 15 and moves past the final solid element 22 along the plane of the planar surfaces 23 of the solid elements 21 in the first part 19 of the fabric-facing surface 18, the permeable fabric 6 will not contact the final solid element 22. The exact value of the distance D (see FIG. 3) depends on the circumstances of each individual case but in some embodiments contemplated by the inventors, the distance D may be in the range of 3 mm-10 mm, for example 5 mm or 7 mm but other values for the distance D are also conceivable and the distance D may conceivably be larger than 10 mm. The final solid element 22 is separated from a preceding solid element 21 such that a final channel 25 is defined between the final solid element 22 and the preceding solid element 21. The final channel 25 is capable of communicating with at least one source of underpressure for the final channel 25 when the at least one source of underpressure for the final channel 25 is connected to the suction device 15 such that an underpressure can be generated in the area between the permeable fabric 4, 6 and the surface of the final solid element 22. In the embodiment shown in FIG. 3 and FIG. 4, the source of underpressure 26 is the same for both the final channel 25 and the preceding channels 24 but embodiments are conceivable in which this is not the case.

With reference to FIG. 3 and FIG. 4, it can be seen that the suction device 15 may have a housing 36 that holds the solid elements 21, 22 such that the solid elements 21, 22 are secured/fastened to the housing 36 or in the housing 36.

With reference to FIG. 4 and FIG. 5, the solid elements 21, 22 can be understood as ribs that extend in a direction substantially perpendicular to the machine direction, i.e. in the cross machine direction and that also have a certain extension in a direction perpendicular to the plane of the planar surfaces 23. The ribs have ends at the fabric-facing surface 18 which ends constitute the surfaces 23, 33 of the solid elements 21, 22.

Figure 9:
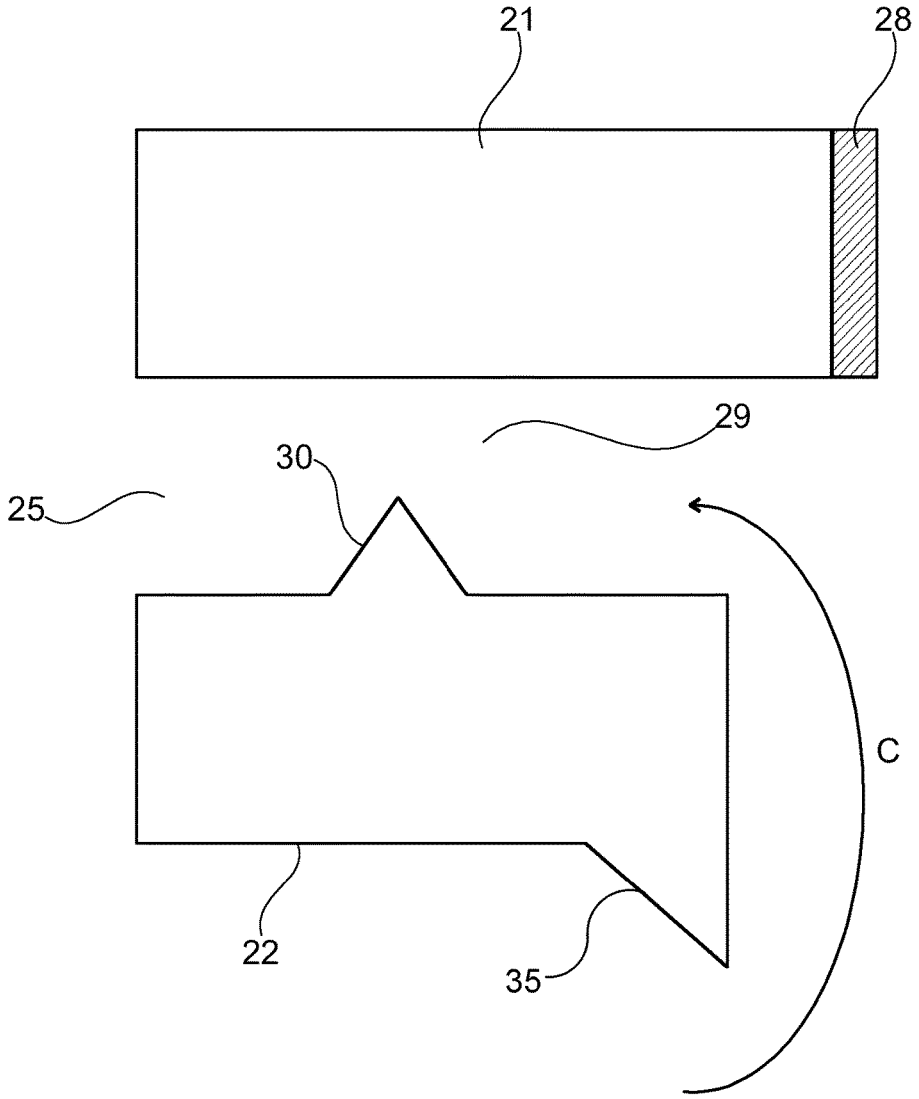
FIG. 9 shows in greater detail the embodiment of FIG. 8 together with yet another optional feature.

With reference to FIG. 9, the ends of some or all solid elements 21, 22 may optionally (but not necessarily) be formed by a piece 28 of a ceramic material such that one or several of the planar surfaces 23, 33 may be formed on a ceramic material. In some embodiments, at least the ends of the ribs that constitute surfaces of the solid elements 21 in the first part of the fabric-facing surface 18 are made of a ceramic material 28. The use of a ceramic material means that friction can be kept low and the resistance to wear is improved.

Figure 8:
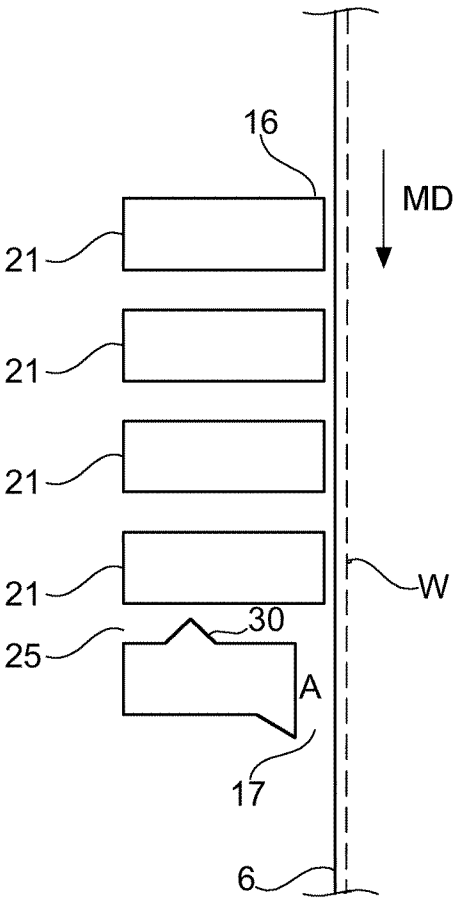
FIG. 8 is a view similar to that of FIG. 7 but showing a different embodiment.
Figure 7:
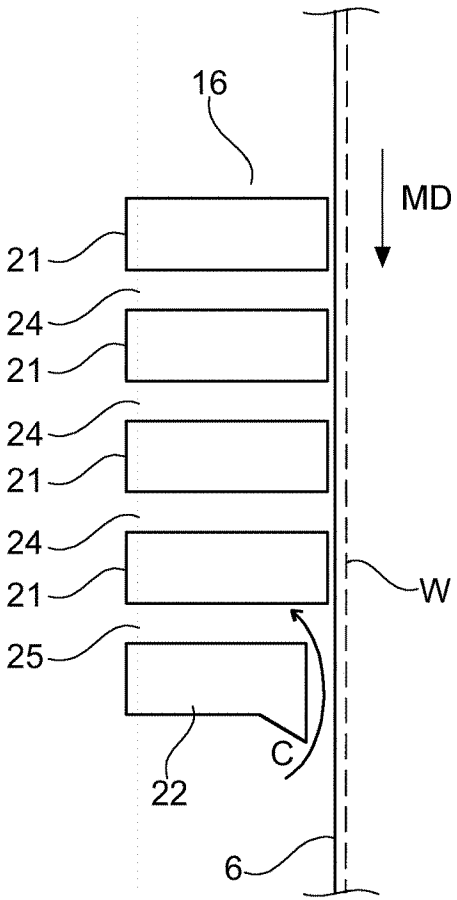
FIG. 7 is a view similar to FIG. 6 but in which an aspect of the interaction with the permeable fabric and the fibrous web has been added.

With reference to FIG. 8 and FIG. 9, it may be so in certain embodiments that at least a part 29 of the final channel 25 formed between the ribs that constitute the final solid element 22 and the solid element 21 immediately preceding the final solid element 22 has a smaller cross-sectional area than the preceding channels 24. This can be achieved in several different ways. For example, the final channel 25 formed between the ribs that constitute the final solid element 22 and the solid element 21 immediately preceding the final solid element 22 may be provided with a flow restrictor 30, for example a flow restrictor which, in cross section, is "pyramid-shaped" as shown in FIG. 9 but other shapes are also conceivable, for example rectangular shapes or flow restrictors 30 which, in cross section, have a curved shape.

Figure 10:
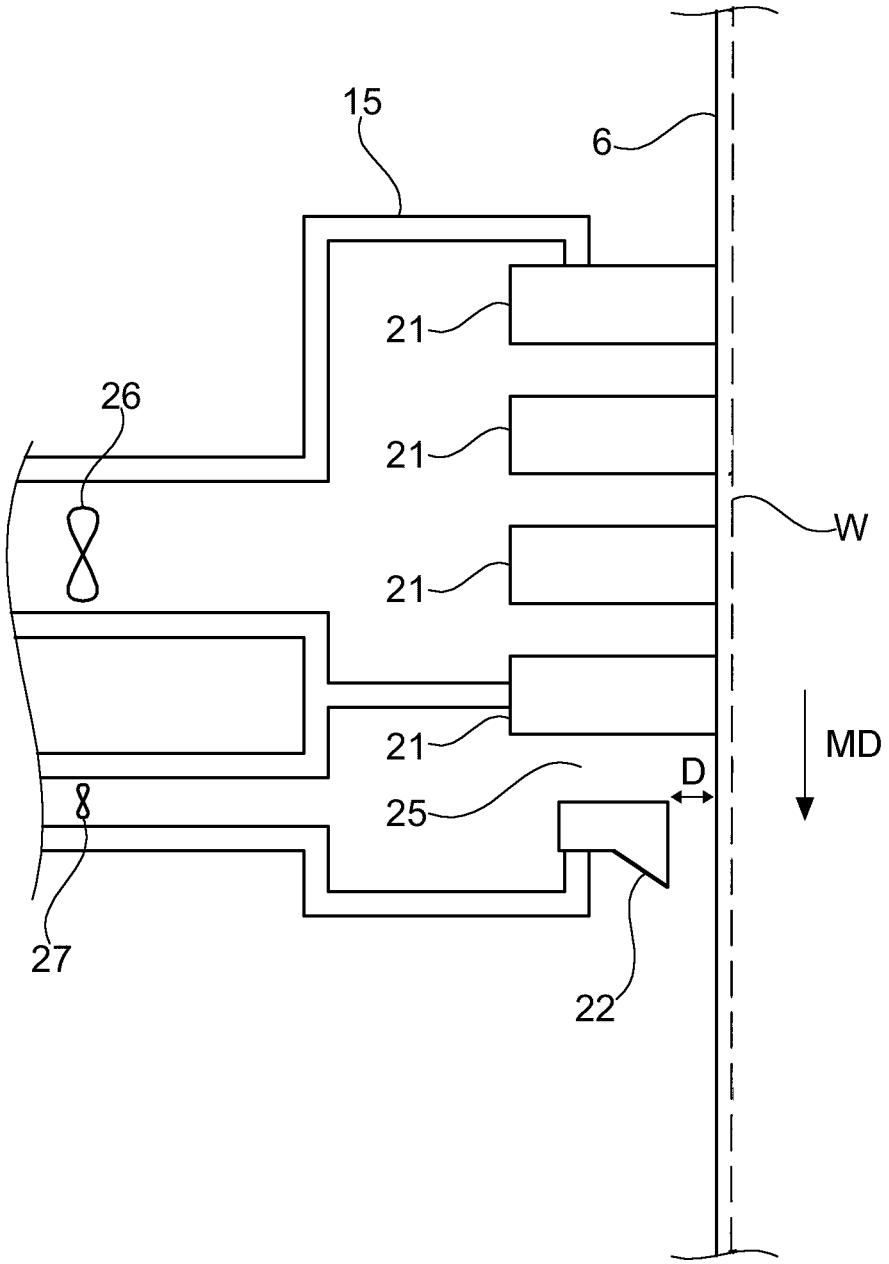
FIG. 10 is a view similar to FIG. 3 but showing an alternative embodiment.
Figure 11:
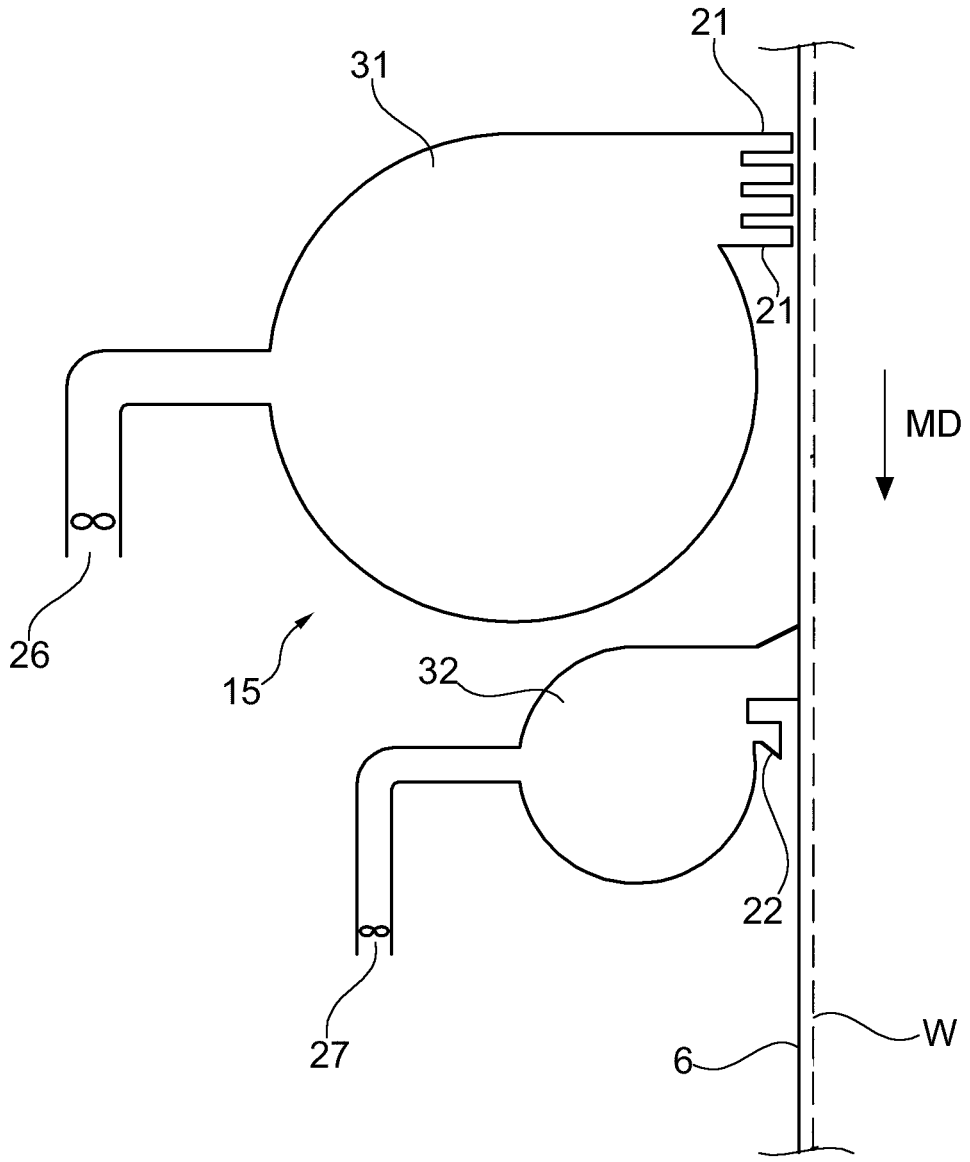
FIG. 11 shows yet another embodiment of the invention.

With reference to FIG. 10, an embodiment is shown in which in which the suction device 15 is configured such that the channels 24 defined between the solid elements associated with the first part 19 of the fabric-facing surface 18 can be connected to and communicate with at least one first source of underpressure 26 and that the final channel 25 can be connected to and communicate with at least one second source of underpressure 27 which is separate from the at least one first source or underpressure 26. In FIG. 11, the first and second source of underpressure 26, 27 are symbolically shown as fans (and they may conceivably be or comprise fans).

In embodiments of the invention, a common source of underpressure may be used while the air flow through the final channel 25 is regulated by means of a control valve (not shown in the figures).

The suction device 15 may be formed as a single unit but with reference to FIG. 11, the suction device 15 may be formed by a first unit 31 and a second unit 32. The first unit 31 and the second unit 32 are physically separate from each other and the first part 19 of the fabric-facing surface 18 is formed on the first unit 31 while the second part 20 of the fabric-facing surface 18 is formed on the second unit 32.

The function of the inventive suction device will now be explained with reference to FIG. 3, FIG. 7, FIG. 8 and FIG. 9. As can be seen in FIG. 3 and FIG. 8, there is a gap A between the permeable fabric 6 and the surface 33 of the final solid element 22. This is because the surface 33 does not lie in the same plane as the planar surfaces 23 of the previous solid elements 21. This allows air to flow between the fabric and the final solid element 22 as indicated by the arrow C in FIG. 7 and FIG. 9. The air flow through the final channel 25 will then catch fines, small fibers and water droplets and draw them into the final channel 25 thereby counteracting a build-up of large lumps of fines and fibers. Testing of the suction device has showed that, during operation, the final channel will quickly be blinded by fibers that lump together and act as a porous vacuum assisted wicket or gate. An effect of this blinding is that the air flow required is reduced and no significant additional vacuum capacity is required. The invention has been tested on a paper machine configuration where a suction device according to the present invention was used as a moulding box in a position upstream of a TAD cylinder (i.e. with a suction device 15 placed as shown in FIG. 1). The trials showed that the occurrence of breaks and defects was significantly reduced. Without wishing to be bound by theory, the inventors believe that the inventive form of the suction device has the effect that fines and fibers that get blind the final channel are dewatered by the air flow and that, instead of falling off in large lumps, they fall off the suction device in the shape of individual fines or fibers that are substantially dry and that are individually too small to cause any noticeable disturbances.

With reference to FIG. 9, it can be seen that the final solid element 22 may have an extension 35 that is shaped as a triangle pointing in the machine direction. This extension 35 is optional and need not be present. When present, the extension 35 may serve to extend the length of the gap A. It may also serve to guide away condensated water droplets. The extension 35 (if present) may also be used simply for the purpose of securing the final element 22 to the housing 36.

In embodiments where the final channel 25 has a part 29 with a smaller cross-sectional area than the preceding channels 24, for example if it has a flow restrictor 30, this entails the advantage that it will be easier to achieve the effect that the final channel 25 gets blinded such that the required air flow is reduced.

In the configuration of FIG. 1, wet lumps of fines and fibers may fall downwards in a direction towards the through-air drying cylinder 9 if the suction device 15 is a conventional moulding box. However, when a suction device 15 according to the present invention is used, this problem can be at least significantly reduced.

In the configuration of FIG. 1, the suction device 15 is vertically oriented or substantially vertically oriented. However, the inventive suction device need not necessarily take the form of a moulding box in a TAD machine but could also be used in other places in a paper making machine, for example in such configurations in which the endless permeable fabric is a forming fabric 4 in the forming section. In such cases, the fabric-facing surface 18 of the suction device 15 need not be vertically arranged but could have an orientation that is horizontal or deviates from a horizontal orientation by no more than 15°. The fabric-facing surface 18 of the suction device 15 is then facing downwards such that the permeable fabric 4 passes below the suction device 15. An example of such a configuration is shown in FIG. 2 where a suction device could be employed for additional water removal in the forming section but it should be understood that the configuration of FIG. 2 is only an example since suction devices may be placed in a horizontal or substantially horizontal position inside the loop of practically any permeable fabric in a paper making machine. Of course, it may also be placed in a vertical position for a number of reasons or in such a position that its orientation is somewhere between a vertical orientation and a horizontal orientation.

The invention may thus be understood also in terms of a papermaking machine that makes use of the inventive suction device. The machine according to the invention comprises a forming section 2 and a drying section 8 and the machine is arranged to cause a newly formed fibrous web W to move along a path of travel that extends in the machine direction from the forming section 2 to and into the drying section 8. The papermaking machine 1 comprises an endless permeable fabric 4, 6 and a plurality of guide rolls 7 around which the endless permeable fabric 4, 6 runs in a loop and the endless permeable fabric 4, 6 is arranged to carry the fibrous web W at least a part of the path of travel of the web W and the papermaking machine 1 comprises a suction device 15 according to the invention and the suction device 15 is arranged inside the loop of the endless permeable fabric 4, 6 with the fabric-facing surface 18 facing the endless permeable fabric.

In one embodiment of the inventive machine, the drying section comprises a through-air-drying cylinder 9 and the endless permeable fabric 6 is a through-air-drying fabric which is arranged to wrap a part of the through-air-drying cylinder 9 and the suction device 15 is placed within the loop of the permeable fabric 6 such that it can act on the permeable fabric 6 and on a fibrous web W carried by the permeable fabric 6 and separated from the suction device 15 by the permeable fabric 6. The suction device 15 is then placed upstream of the through-air-drying cylinder 9 such that it acts on the permeable fabric 6 before the permeable fabric 6 reaches the through-air-drying cylinder 9, and the fabric-facing surface 18 of the suction device 15 has an orientation that is more vertical than horizontal.

The surface 33 of the final solid element 22 may be planar just as the planar surfaces 23 of the solid elements belonging to the first part 19 of the fabric-facing surface 18 but it could also have another shape, for example a round shape. Since the final solid element 22 will not contact the permeable fabric 4, 6, the final solid element 22 and the surface 33 may very well be formed in a material such as High Density Polyethylene (HDPE) which is less expensive and which can easily be machined.

The inventive suction device is in particular useful as a moulding box in a TAD machine (a Through Air Drying machine) for making through-dried tissue paper such as tissue paper having a basis weight in the range of, for example, 10 g/m$^2$-30 g/m$^2$ but it could also be used as, for example, a transfer suction box in a tissue paper making machine or as a dewatering element in, for example, the forming section of a tissue paper making machine such as a TAD machine. While the inventive suction device may be particularly useful in TAD machines, it may also be used in other tissue machines than TAD machines, for example as a transfer suction box or dewatering element.

While the inventive suction device is in particular intended for tissue machines (e.g. TAD machines), it may also be applied in machines for heavier grades than tissue.

It should also be understood that the invention may be defined in terms of a method of operating the inventive papermaking machine. In such a method, the newly formed fibrous web would be caused to travel along a path of travel extending in the machine direction from the forming section and to the drying section and thereby pass the inventive suction device while at least one source of underpressure was connected to the inventive suction device and the source of underpressure is active (operated) to produce underpressure such that a suction effect through the suction device is generated and underpressure acts through the permeable fabric on the fibrous web as the fibrous web passes the inventive suction device.

The invention claimed is:

1. A suction device (15) in a papermaking machine (1) and being suitable for acting on a wet fibrous web (W) through a permeable fabric (4, 6) that runs through a part of the papermaking machine (1), the suction device (15) comprising:

a length (L) that extends from a first end (16) to a second end (17) which first end (16) is an upstream end when the suction device (15) is used in the papermaking machine (1) and which second end (17) is a downstream end in the papermaking machine (1), the direction from the first end (16) to the second end (17) being the machine direction (MD) in the papermaking machine (1), a width (B) which is perpendicular to the length (L) of the suction device (15) and extends in the cross-machine direction in the papermaking machine (1), a surface (18) which, during use of the suction device (15) in the papermaking machine, will be facing the permeable fabric (4, 6) and thus be a fabric-facing surface (18), a first part (19) which begins at the first end (16) of the suction device (15) and extends towards the second end (17) but ends before the second end (17) of the suction device, the first part (19) of the fabric-facing surface (18) being formed by a plurality of planar surfaces (23) which planar surfaces (23) constitute end surfaces of a plurality of solid elements (21), the planar surfaces (23) of the solid elements (21) in the first part (19) of the fabric-facing surface (18) lying in the same plane such that, during operation, they can contact a fabric (4, 6) gliding over the fabric-facing surface (18) along a straight path, the solid elements (21) being separated from each other along the length of the suction device (15) such that channels (24) are defined between the solid elements (21), and a second part (20) of the fabric-facing surface (18) following the first part (19), the second part (20) of the fabric-facing surface (18) being a surface (33) formed as an end surface of a final solid element (22) and which end surface (33) of the final solid element 22 does not lie in the same plane as planar surfaces (23) of the solid elements (21) belonging to the first part (19) of the fabric-facing surface (18) but is spaced from the plane in which the planar surfaces (23) of the solid elements (21) belonging to the first part (19) of the fabric-facing surface (18) lie such that, when the permeable fabric (4, 6) passes over the suction device (15) and moves past the final solid element (22) along the plane of the planar surfaces of the solid elements (21) belonging to the first part (19) of the fabric-facing surface (18), the permeable fabric (4, 6) will not contact the final solid element (22), the final solid element (22) being separated from a preceding solid element (21) such that a final channel (25) is defined between the final solid element (22) and the preceding solid element (21), wherein:

the suction device (15) is configured to be connected to at least one source of under-pressure (26, 27) in such a way that the at least one source of under-pressure (26, 27) is in communication with the channels (24) defined between the solid elements (21) such that, when the suction device (15) is used and the permeable fabric (4, 6) runs over the fabric-facing surface (18), the suction device (15) can act on the permeable fabric (4, 6) through the channels (24) and draw the permeable fabric (4, 6) by suction effect towards the fabric-facing surface (18), and the final channel (25) communicating with at least one source of under-pressure (26, 27) for the final channel (25) when the at least one source of under-pressure (26, 27) for the final channel (25) is connected to the suction device (15) such that an under-pressure is generated in the area between the permeable fabric (4, 6) and the surface of the final solid element (22).

2. A suction device (15) according to claim 1, wherein the solid elements (21, 22) are ribs that extend in a direction perpendicular to the machine direction and the cross machine direction and to the length and width dimension of the suction device, the ribs having ends at the fabric-facing surface (18) which ends constitute the surfaces (23, 33) of the solid elements (21, 22).

3. A suction device according to claim 2, wherein at least the ends of the ribs that constitute surfaces of the solid elements (21) in the first part of the fabric-facing surface (18) are made of a ceramic material (28).

4. A suction device according to claim 2, wherein at least a part (29) of the final channel (25) formed between the ribs that constitute the final solid element (22) and the solid element (21) immediately preceding the final solid element (22) has a smaller cross-sectional area than the preceding channels (24).

5. A suction device (15) according to claim 2, wherein the final channel (25) formed between the ribs that constitute the final solid element (22) and the solid element (21) immediately preceding the final solid element (22) is provided with a flow restrictor (30).

6. A suction device according to claim 1, wherein the suction device (15) is configured such that the channels (24) defined between the solid elements of the first part (19) of the fabric-facing surface (18) is connected to and communicate with at least one first source of under-pressure (26) and that the final channel (25) can be connected to and communicate with at least one second source of under-pressure (27) which is separate from the at least one first source or under-pressure (26).

7. A suction device according to claim 6, wherein the suction device (15) is defined by a first unit (31) and a second unit (32) which first and second units (31, 32) are physically separate from each other, the first part of the fabric-facing surface (18) being defined on the first unit (31) and the second fabric-facing surface (18) being defined on the second unit (32).

8. A suction device according to claim 6, wherein the suction device (15) is defined as a single unit.

9. A suction device according to claim 1, wherein the suction device (15) is configured such that both the channels (24) defined between the solid elements (21) of the first part (19) of the fabric-facing surface (18) and the final channel (25) are all connectable to and configured to communicate with at least one common source of under-pressure (26).

10. A papermaking machine comprising:

a forming section (2), a drying section (8), an endless permeable fabric (4, 6) and a plurality of guide rolls (7) around which the endless permeable fabric (4, 6) runs in a loop, and the suction device (15) according to claim 1, wherein:

the machine is configured to cause a newly formed fibrous web (W) to move along a path of travel that extends in the machine direction from the forming section (2) to and into the drying section (8), the endless permeable fabric (4, 6) is configured to carry the fibrous web (W) at least a part of the path of travel of the web (W), and the suction device (15) is arranged inside the loop of the endless permeable fabric (4, 6) with the fabric-facing surface (18) facing the endless permeable fabric.

11. A papermaking machine according to claim 10, wherein:

the drying section comprises a through-air-drying cylinder (9) and the endless permeable fabric (6) is a through-air-drying fabric which is arranged to wrap a part of the through-air-drying cylinder (9), and the suction device (15) is placed within the loop of the permeable fabric (6) such that it can act on the permeable fabric (6) and on a fibrous web (W) carried by the permeable fabric (6) and separated from the suction device (15) by the permeable fabric (6), the suction device (15) being placed upstream of the through-air-drying cylinder (9) such that it acts on the permeable fabric (6) before the permeable fabric (6) reaches the through-air-drying cylinder (9), the fabric-facing surface (18) of the suction device (15) having an orientation that is more vertical than horizontal.

12. A papermaking machine according to claim 10, wherein:

the endless permeable fabric (4) is a forming fabric (4) in the forming section and the fabric-facing surface (18) of the suction device (15) has an orientation that is horizontal or deviates from a horizontal orientation by no more than 15° , and the fabric-facing surface (18) of the suction device (15) is facing downwards such that the permeable fabric (4) passes below the suction device (15).

* * * * *